US006056321A

United States Patent [19]

Donley

[11] Patent Number: 6,056,321

[45] Date of Patent: May 2, 2000

[54] METHOD OF FOLDING

[76] Inventor: Andrew Donley, 1756 Childerlee La., Atlanta, Ga. 30329

[21] Appl. No.: 09/062,065

[22] Filed: Apr. 17, 1998

[51] Int. Cl.[7] ..... B42F 21/00; B65H 45/00

[52] U.S. Cl. ..... 281/2; 283/34; 283/36; 281/2; 281/3; 270/61 R; 40/102

[58] Field of Search ..... 493/210, 227, 493/231, 235, 239, 356; 270/37, 60; 281/5, 2; 283/34, 35, 36; 462/25, 8; 428/121; 206/412, 393; 40/117, 518, 610, 904

[56] References Cited

U.S. PATENT DOCUMENTS

| | | | |
|---|---|---|---|
| 596,484 | 1/1898 | Crawford . | |
| 625,844 | 5/1899 | Kelso, Jr. . | |
| 674,146 | 5/1901 | White . | |
| 1,853,223 | 4/1932 | Power . | |
| 1,874,857 | 8/1932 | Beatty . | |
| 2,179,172 | 11/1939 | Bonnaire . | |
| 2,572,460 | 10/1951 | Falk | 281/1 |
| 2,860,439 | 11/1958 | Johnson . | |
| 3,143,363 | 8/1964 | Falk | 283/35 |
| 3,186,543 | 6/1965 | Minick et al. . | |
| 3,476,238 | 11/1969 | Wright et al. . | |
| 4,046,368 | 9/1977 | Le Breton | 270/61 |
| 4,576,279 | 3/1986 | Federber | 206/225 |
| 4,856,818 | 8/1989 | Rabenecker et al. | 283/34 |
| 5,217,257 | 6/1993 | Knoors | 283/34 |
| 5,222,932 | 6/1993 | Fontecchio | 493/210 |
| 5,794,980 | 8/1998 | Bigler | 281/2 |

FOREIGN PATENT DOCUMENTS

| | | | |
|---|---|---|---|
| 4416370 | 5/1994 | Germany | G09F 1/06 |

*Primary Examiner*—Willmon Fridie, Jr.
*Assistant Examiner*—Alisa Thurston
*Attorney, Agent, or Firm*—Geoff L. Sutcliffe; Kilpatrick Stockton LLP

[57] ABSTRACT

Booklets produced from a web of material which is cut, folded and joined in a manner that allows presentation of multiple pages of material. Tabs, which are cut from the web of material, are folded and joined to each other in to create a ribbon which winds through the "pages" of the booklet to allow the pages to be unfolded without expanding the booklet.

18 Claims, 6 Drawing Sheets

METHOD OF FOLDING

BACKGROUND OF THE INVENTION

Paper, fabric, cardboard and other thin, pliable webs may be used to form maps, calendars, business cards, brochures, and many other useful formats for conveying printed information. One problem with these information formats is the limited space available upon which information may be printed. To resolve this problem, the information may be printed using small type and images, making the object difficult to read. Alternatively, information may be left out, making the object incomplete and therefore less useful. Most commonly, however, the object is simply made larger to accommodate the desired amount of information. The object could be folded to temporarily reduce its size. For example, a map covering a large area may be printed on a very large sheet of paper which is folded to a smaller size for carrying and storage. Nonetheless, in order to use the map, it must be at least partially unfolded, expanding the map to an unwieldy size.

Another approach is to provide the information in book form. For example, a the entire area of a map may be broken up into pages which are then bound. In this manner, the map need never be expanded to an unwieldy size; however, the cost of the maps greatly increased due to the addition materials and processes required to bind the pages. Similarly, it may be desirable to include large amounts of information on product brochures, pocket calendars and even business cards. However, these items are less effective as marketing or advertising tools if they are large, bulky or unwieldy. Thus, these items often are provided in folded or bound "book" form, greatly increasing their production costs. Moreover, the multiple pages of such books may become dog-eared or torn as the pages are turned or if the book opens inadvertently during storage or transport, reducing the aesthetic appeal of the item or even obliterating valuable information.

SUMMARY OF THE INVENTION

"Booklets" in accordance with the present invention are produced from a web of material which is cut, folded and joined in a manner that allows presentation of multiple pages of material without the use of a conventional binding. Tabs, which are cut from the web of material, are folded and joined to each other in to create a ribbon which winds through the "pages" of the booklet to allow the pages to be unfolded without expanding the booklet. Thus, the pages of the booklet are rotated with respect to each other to present subsequent pages. There may be one or more such ribbons and each ribbon may be varied in shape; from straight and lateral to curved, diagonal or patterned cuts. The web pattern may also contain extra material which could be used for pockets. The pages also may be patterned in different shapes and the booklet may be formed about one or more three-dimensional objects.

No conventional binding is necessary to hold the pages together and, while multiple pages may be presented to a user as the pages are rotated, the booklet is never expanded beyond its original size. Thus, although there are multiple pages of information, the booklet always appears to be a two page pamphlet, thereby hiding the other pages from view and protecting them from damage. In this manner, the object may contain relatively large volumes of information in a small, compact form in which all of the information is readily accessible without the need for enlarging or expanding the size of the object. Moreover, because no conventional binding is necessary, the cost and complexity of manufacturing the object is substantially reduced.

Accordingly, it is an object of the present invention to provide a booklet that may contain large amounts of printed information in a relatively small package.

Another object of the present invention to provide a booklet with multiple pages that presents only two pages at a time.

A further object of the present invention provide a booklet with multiple pages that presents only two pages at a time in which the pages are varied in shape and size.

Other objects, features, and advantages of the present invention will become apparent with reference to the remainder of the written portion and the drawings of this application.

DETAILED DESCRIPTION

Figure 1:
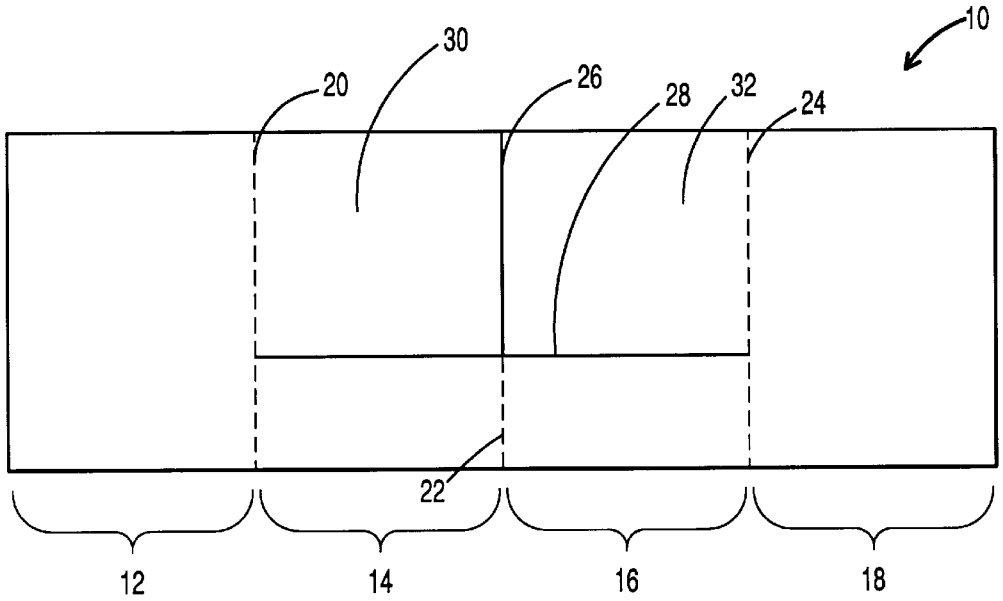
FIG. 1 shows a web with cut lines (solid) and fold lines (broken) to make a booklet in accordance with the present invention.
Figure 2:
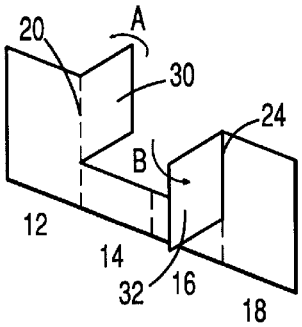
FIG. 2 is a perspective view of the web of FIG. 1 with the tabs partially folded.
Figure 3:
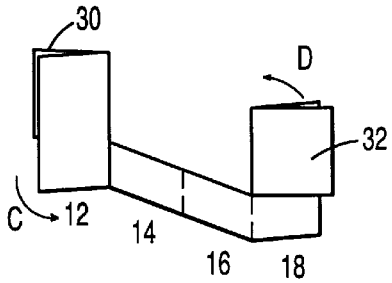
FIG. 3 is a perspective view of the web of FIG. 1 with the pages partially folded.
Figure 4:
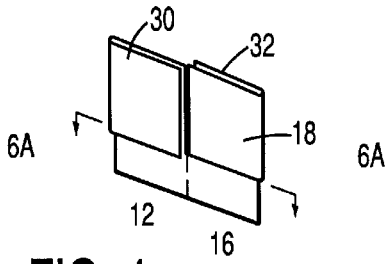
FIG. 4 is a perspective view of the web of FIG. 1 with the tabs and pages fully folded.
Figure 5:
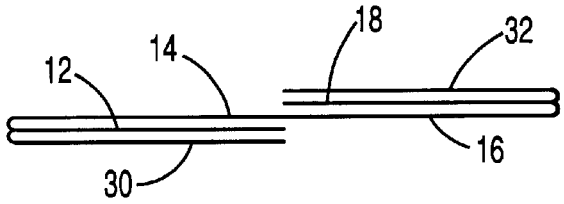
FIG. 5 is a top view of the web of FIG. 1 with the tabs and pages fully folded.

FIG. 1 illustrates a web 10 which is cut and creased to form a booklet in accordance with the present invention.

Web 10 may be made of any suitable material, such as paper, cardstock, cardboard, plastic, cellophane or any other thin, flexible material. It may also made of metal or other materials and have pin hinges at the foldable joints. Web 10 is generally rectangular, although other shapes may be used as desirable or appropriate. Web 10 is divided into four panels 12, 14, 16 and 18, all of the panels being of about equal width. Web 10 is creased along lines 20, 22 and 24. Web 10 is cut along central line 26 and lateral line 28, forming tabs 30 and 32. Central line 26 is positioned at about the midpoint of web 10. Lateral line 28 extends in both directions from and perpendicularly to central line 26 along the entire width of web 10 up to panels 12 and 18, the outermost panels defined on web 10. Thus, tabs 30 and 32 run along the length of web 10 up to, but not including the outermost panels 12 and 18.

Figure 6:
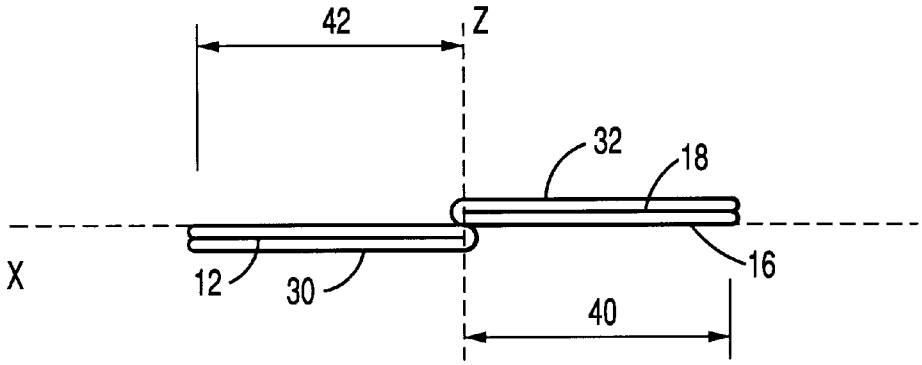
FIG. 6 is a top view of the web of FIG. 1 with the tabs and pages fully folded and the tabs fastened together.

FIGS. 2–6 show the process for assembling web 10 into a booklet in accordance with the present invention. Tabs 30 and 32 are folded in directions A and B, respectively, so that they lay against panels 12 and 18, respectively, but on opposite sides of web 10. Directions A and B may be clockwise or counter-clockwise; however, direction A should correspond to direction B. In other words, if direction A is counter-clockwise, direction B is also counter-clockwise. Panels 12 and 18 are then folded in directions C and D, respectively, so that they lay against panels 14 and 16, respectively, but on opposite sides of web 10. Directions C and D correspond to each other and to directions A and B. In other words, if directions A and B are counter-clockwise, directions C and D also are counter-clockwise. Once folding is complete, the ends of tabs 30 and 32 are joined across the plane X as shown in FIG. 6. Tabs 30 and 32 may be joined with adhesives, staples, tape, spliced or any other suitable means for joining the material used for web 10.

Figure 6A:
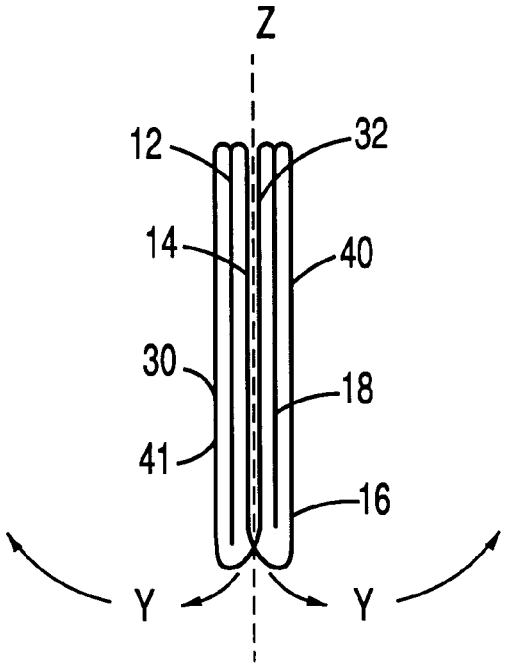
FIG. 6A is a top view of the web of FIG. 6 being folded to rotate pages.
Figure 6B:
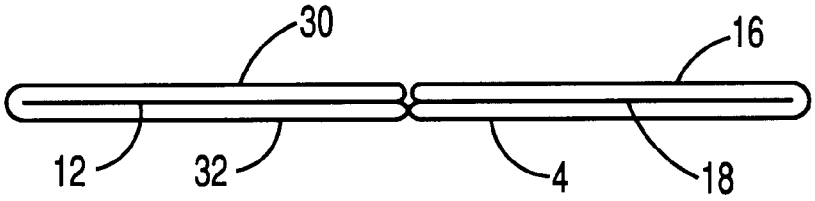
FIG. 6B is a top view of the web of FIG. 6 after one rotation of pages.

Once web 10 is assembled into a booklet as shown in FIG. 6, the "pages" 40 and 42 of the booklet may be folded against each other along axis Z, as shown in FIG. 6A. The pages are then folded outward in direction Y, allowing the pages to rotate around each other and resulting in the configuration shown in FIG. 6B. The pages may be rotated in this manner in either direction. The total number of pages presented to the user is equal to twice the number of panels into which web 10 was originally divided. Thus, the booklet illustrated in FIGS. 6A and 6B, which was made from web 10, presents a total of eight pages. Nonetheless, the booklet never expands to present more than two pages at a time. In other words, the booklet presents the appearance of repeatedly opening upon itself until the last page is reached.

Figure 7:
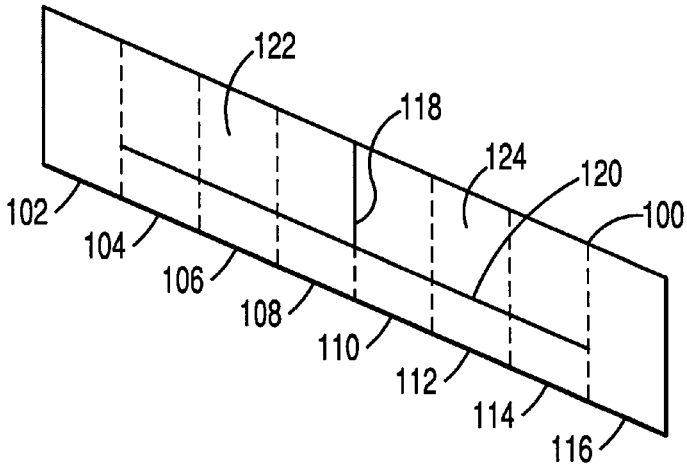
FIG. 7 is a perspective view of a first alternate embodiment of the present invention partially assembled.
Figure 8:
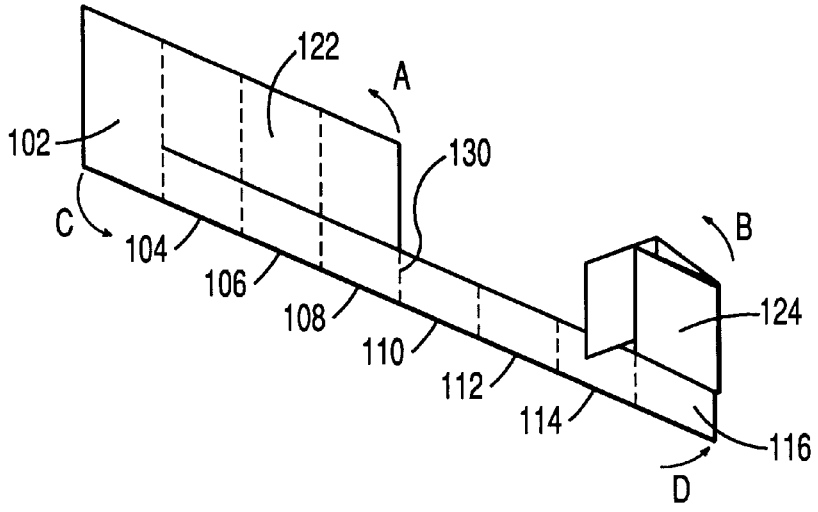
FIG. 8 is a perspective view of the embodiment of FIG. 8, partially folded.

As shown in FIGS. 7–10, booklets in accordance with the present invention may be made in various different styles and with any number of pages. For example, FIGS. 7 and 8 show a web 100 divided into eight panels 102–116, all of the panels being of about equal width. Web 100 is cut along central line 118 and lateral line 120, forming tabs 122 and 124. Central line 118 is positioned at about the midpoint of web 100. Lateral line 120 extends in both directions from and perpendicularly from central line 118 along the entire width of web 100 up to panels 102 and 116, the outermost panels defined on web 100. Thus, tabs 122 and 124 run along the length of web 100 up to, but not including the outermost panels 102 and 116.

Web 100 is folded in a manner similar to that described above for web 10, i.e., tab 124 is folded in one direction B and tab 122 is folded in the same direction A. Tabs 122 and 124 are folded so that they wrap around the outermost panels 102 and 116, respectively, of web 100. Once tabs 122 and 124 are completely folded, the panels 102–116 are folded about central crease line 130, beginning with the outermost panels 102 and 116 and working inward so that the inner panels are wrapped around the outermost section. The directions C and D of folding the panels 102–116 correspond to directions A and B. Once the folding is complete, tabs 122 and 124 are joined across the plane of web 100. Tabs 122 and 124 may be joined with adhesives, staples, tape, spliced or any other suitable means for joining the material used for web 100. In this manner, web 100 is formed into a booklet having properties similar to those described above, except that the booklet formed from web 100 presents sixteen pages to a user. At the same time, the booklet formed from web 100 presents only two pages to the user at any time.

Figure 9:
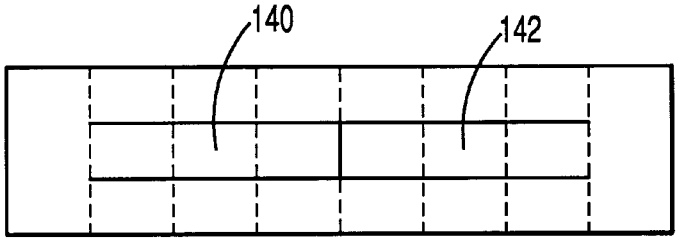
FIG. 9 is a plan view of a second alternate embodiment of web showing cut lines (solid) and fold lines (broken) to make a booklet in accordance with the present invention.
Figure 10:
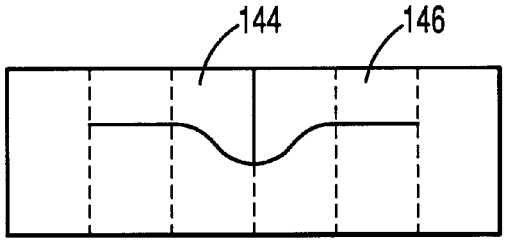
FIG. 10 is a plan view of a third alternate embodiment of web showing cut lines (solid) and fold lines (broken) to make a booklet in accordance with the present invention.

Thus, booklets of any number of pages may formed using the same technique, i.e., dividing a web into a number of equal panels, partially cutting the web along a central line and a lateral line to form tabs which extend across all but the panels at either end of the web, folding the tabs about the end panels, folding the panels about the central line and joining the tabs across the plane of the web. Of course, the various elements of the invention may be varied to provide different aesthetic and visual effects. For example, as shown in FIG. 9, the tabs 140 and 142 may be cut from the interior of the web. Also, as shown in FIG. 10, the tabs 144 and 146 need not be rectangular, but may be cut in any shape or design. Thus, the shape and position of the tabs may be varied, as may be the width and number of panels.

Figure 11:
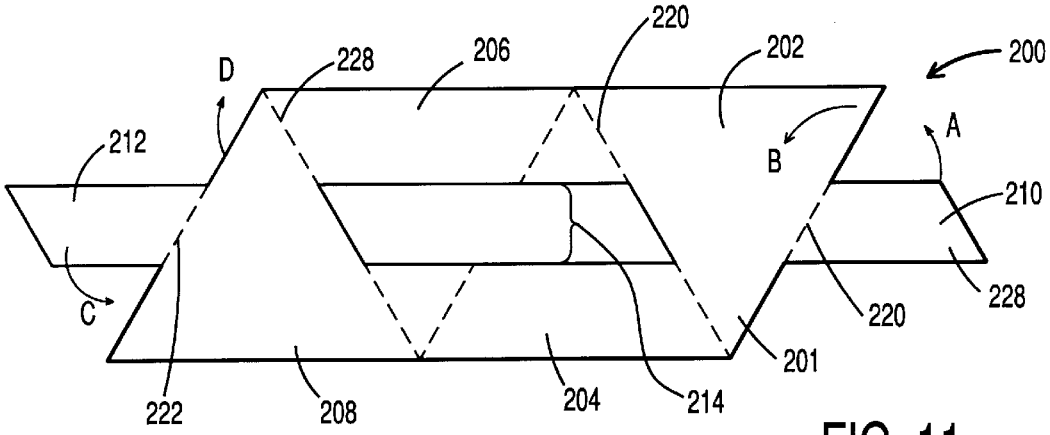
FIG. 11 is a plan view of a fourth alternate embodiment of web showing cut lines (solid) and fold lines (broken) to make a booklet in accordance with the present invention.
Figure 12:
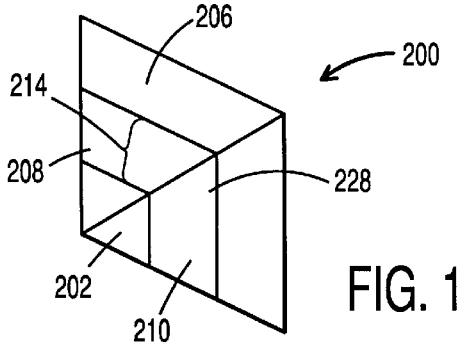
FIG. 12 is a perspective view of the booklet of FIG. 11 shown assembled.

FIGS. 11–12 illustrate another illustrative embodiment of a booklet 200 in accordance with the present invention that is triangular in shape. As shown in FIG. 11, web 201 is cut into a parallelogram and divided into panels 202, 204, 206 and 208. Tabs 210 and 212 extend from either end of web 201 and extend for about the width of a panel at position of the tab. Tabs 210 and 212 are shaped to conform with the adjacent panel when they are folded thereon as described below. Cutout 214 is provided in the central region of web 201. Cutout 214 corresponds in size, shape and position to tabs 210 and 212 and extends through the interior panels 204 and 206 of web 201, but terminates at the outermost panels 202 and 208.

To assemble booklet 200, tab 200 is folded along dotted line 220 behind panel 202 in direction A. Tab 212 is folded down in front of panel 208 along dotted line 222 in direction C. Panel 202 is then folded down along dotted line 224 in front of panel 204 in direction B while panel 208 is folded up along dotted line 228 behind panel 206 in direction D. Once web 201 is folded as shown in FIG. 12, free end 228 of tab 210 is affixed to the free end of tab 212 (not visible in FIG. 12). Once booklet 200 is assembled, it may be opened and its pages turned in a manner similar to that described above with the other illustrative embodiments.

In alternative embodiments (not shown) tabs 210 and 212 may be positioned at the bottom or top edges of web 201. Also, multiple parallel tabs could be used. The tabs also may be shaped or patterned for visual effect. Alternatively, web 210 could extend for the length of two portions and tab 212 could be eliminated. In the same vein, a ribbon the length of two portions could be made separately and affixed to web 201. In the event more than four panels are used, tabs 210 and 212 and cutout 214 may be lengthened accordingly. Also, booklets having different shapes may be assembled in a similar manner.

Figure 13:
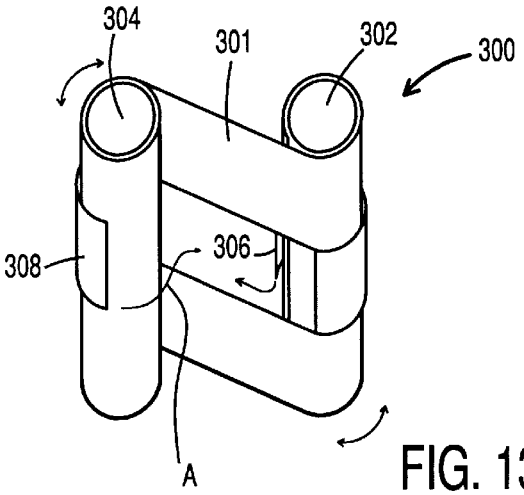
FIG. 13 is a perspective view of a fourth alternate embodiment of a booklet in accordance with the present inventions shown partially assembled.
Figure 14:
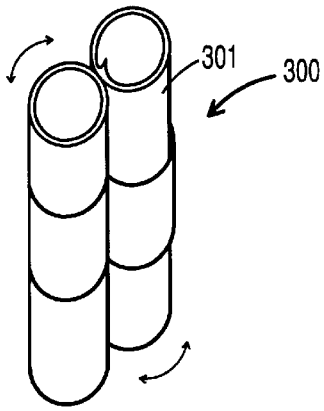
FIG. 14 is a perspective view of the booklet of FIG. 13 shown fully assembled.

FIGS. 13–16 show an alternate embodiment of a booklet 300 in accordance with the present invention in which the booklet includes a three-dimensional structure. Referring to FIG. 13, web 301, which is essentially configured like the web shown in FIG. 9, is assembled as described above, except that cylinders 302 and 304 is inserted between the folded panels and affixed to the outermost panels of web 301. Tabs 308 and 306 are then joined as indicated by arrow A. Web 301 need not be folded or creased prior to assembly. For example, when used with circular cylinders, web 301 need not be folded or creased at all. With other shapes of cylinders, creases may be made to coincide with the corners of the cylinders.

Figure 15:
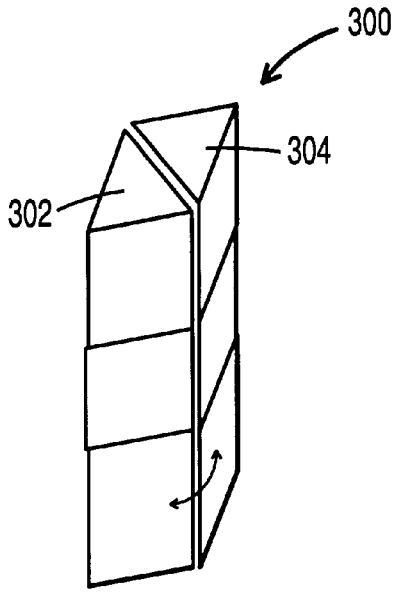
FIG. 15 is a perspective view of a fifth alternate embodiment of a booklet in accordance with the present inventions shown fully assembled.
Figure 16:
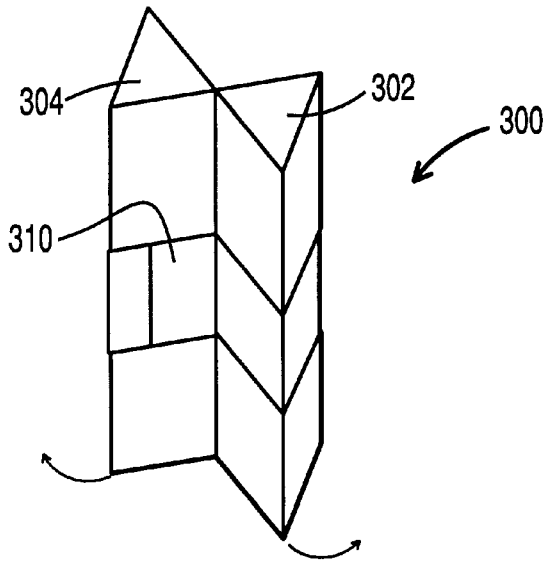
FIG. 16 is a perspective view of the booklet of FIG. 15 shown in an open position.

Once booklet 300 is assembled, cylinders 302 and 304 may be rotated. Thus, rather "flipping pages," the user "scrolls" through the panels. Cylinders 302 and 304 need not be circular in cross section, but may be a cylinder of any cross section. For example, as shown in FIGS. 15 and 16, cylinders 302 and 304 may be triangular in cross-section. Likewise, square, hexagonal, octagonal or any other cross-section could be used. Cylinders 302 and 304 may be solid or hollow. If hollow, Cylinders 302 and 304 may be open at either end, or closed at either end and provided with an opening 310 which would allow objects to be stored within dowels 302 and 304. Opening 310 would only be exposed when the user has scrolled booklet 300 to either end.

The foregoing is provided for purposes of illustration, explanation, and description of an illustrative embodiment of monitoring systems in accordance with the present invention. Modifications and adaptations to this embodiment will be apparent to those skilled in the art and may be made without departing from the scope or spirit of the invention.

I claim:

1. A method for assembling a booklet comprising:

dividing a web having two ends into a plurality of panels;

making a first cut in the web contained entirely within edges of the web and making a second cut in the web with the second cut intersecting the first cut to form two tabs which extend across all of the web but end panels;

folding the two tabs about the end panels;

folding the end panels toward each other; and joining the two tabs to each other.

2. The method of claim 1 wherein making the second cut along a central line is performed by cutting from a top edge of the web to the first cut.

3. The method of claim 1 wherein making the second cut is performed by cutting from a bottom edge of the web to the first cut.

4. The method of claim 3, further comprising making a third cut contained entirely within edges of the web and wherein making the second cut is performed by cutting from the first cut to the third cut.

5. A booklet comprising:

a web having two ends and a top edge divided into a plurality of panels; and two tabs defined entirely within in the web, wherein the tabs are formed from a first cut entirely contained between the two ends of the web and one additional cut intersecting the first cut, the two tabs extending across a width of the web up to, but not including the panels at either end of the web, wherein the two tabs are folded around the panels at either end of the web and are joined to each other across a plane of the web.

6. The booklet of claim 5 in which the tabs are positioned along the top edge of the web.

7. The booklet of claim 5 in which the tabs are positioned within the web.

8. The booklet of claim 5 in which the tabs are generally rectangular.

9. The booklet of claim 5 in which the tabs are curved.

10. The booklet of claim 5 in which the tabs are diagonal or patterned.

11. The booklet of claim 5 further comprising a pair of cylinders positioned within the folded panels and tabs.

12. The booklet of claim 11 in which the cylinders are hollow and define an opening.

13. The method of claim 1, wherein the folding of the tabs about the end panels at either end of the web comprises folding the tabs in opposite directions.

14. The method of claim 1, wherein the folding of the panels toward each other is performed by rotating the panels in opposite directions.

15. A multi-sided product, comprising:

a plurality of panels joined to each other to form a web of panels and defining two end panels located at end of the web; and two tabs joined to the end panels at either end of the web, contained entirely within the web, and extending across a width of the web up to, but not including the end panels;

wherein the panels are separated from each other at a point between the two end panels to define first and second groups of panels which are rotated along with one of the two tabs toward their respective end panels and wherein the two tabs are joined to each other;

wherein the panels are spaced from adjacent panels so as to define a volumetric shape in a space between the panels.

16. The multi-sided product as set forth in claim 15, wherein the volumetric shape is a cylinder.

17. The multi-sided product as set forth in claim 15, wherein the volumetric shape has a circular cross-section.

18. The multi-sided product as set forth in claim 15, wherein the volumetric shape has a square cross-section.

* * * * *